US006189705B1

(12) United States Patent
Saylor et al.

(10) Patent No.: US 6,189,705 B1
(45) Date of Patent: Feb. 20, 2001

(54) NESTABLE-STACKABLE TRAY

(75) Inventors: Charles Saylor, Grand Rapids, MI (US); Sheldon Phillips, Thousand Oaks; Edward Mitchell, Los Angeles, both of CA (US)

(73) Assignee: Haworth, Inc., Holland, MI (US)

( * ) Notice: Under 35 U.S.C. 154(b), the term of this patent shall be extended for 0 days.

(21) Appl. No.: 09/304,164

(22) Filed: Apr. 30, 1999

(51) Int. Cl.[7] ..... B42F 17/00

(52) U.S. Cl. ..... 211/11; 211/194; 211/126.2; 211/126.7

(58) Field of Search ..... 211/11, 194, 126.2, 211/126.7, 10, 126.3, 126.1, 126.4, 126.11, 126.8, 126.9, 126.14, 126.5; 206/503, 505, 511, 508

(56) References Cited

U.S. PATENT DOCUMENTS

| | | | | |
|---|---|---|---|---|
| D. 13,268 | | 8/1882 | Buck . | |
| D. 139,005 | * | 10/1944 | Adams | 211/126.1 X |
| D. 179,534 | | 1/1957 | Bullock et al. . | |
| D. 202,951 | | 11/1965 | Revzin . | |
| D. 232,934 | | 9/1974 | Perry . | |
| D. 240,820 | | 8/1976 | Bell et al. . | |
| D. 316,116 | | 4/1991 | Hawes, Jr. et al. . | |
| D. 348,904 | | 7/1994 | Linder . | |
| 758,777 | * | 5/1904 | Pflugradt et al. | 211/126.1 X |
| 1,867,738 | * | 7/1932 | Fraser | 206/449 |
| 2,187,355 | * | 1/1940 | MacManus | 211/49 |
| 2,360,218 | * | 10/1944 | Gavin | 206/73 |
| 2,599,727 | | 6/1952 | Schmidt . | |
| 2,704,974 | | 3/1955 | Setman . | |
| 3,126,101 | * | 3/1964 | John | 211/176 |
| 3,393,827 | | 7/1968 | Asenbauer . | |
| 3,968,881 | * | 7/1976 | Beil et al. | 211/128.1 |
| 4,113,329 | * | 9/1978 | Thurman | 312/111 |
| 4,253,402 | * | 3/1981 | Carrig et al. | 108/27 |
| 4,457,432 | * | 7/1984 | Solheim | 206/503 |
| 4,763,795 | * | 8/1988 | Metzger et al. | 211/11 |
| 4,884,513 | | 12/1989 | Newhouse et al. . | |
| 4,938,442 | | 7/1990 | Mastrodicasa . | |
| 4,974,913 | | 12/1990 | Vogt et al. . | |
| 5,103,741 | | 4/1992 | Grund et al. . | |
| 5,363,974 | | 11/1994 | Chan . | |
| 5,486,042 | | 1/1996 | Heisler et al. . | |
| 5,641,074 | * | 6/1997 | Smed | 211/11 |
| 5,775,521 | | 7/1998 | Tisbo . | |

* cited by examiner

*Primary Examiner*—Daniel P. Stodola
*Assistant Examiner*—Khoa Tran
(74) *Attorney, Agent, or Firm*—Flynn, Thiel, Boutell & Tanis, P.C.

(57) ABSTRACT

A shallow tray of the type for use on a worksurface or other support top having a construction which enables several such trays to be disposed vertically one above the other and at least partially nested one within another, either when the trays are empty or contain only a small number of documents therein to permit compact storage on a worksurface top while utilizing minimal space. The tray construction in addition allows the trays to be vertically cross-stacked one on top of another to provide for desired vertical separation and hence at least limited visibility and access to the individual trays in the stack, while at the same time providing significant storage capability and document separation while minimizing the amount of space utilized on the worksurface top.

14 Claims, 3 Drawing Sheets

NESTABLE-STACKABLE TRAY

FIELD OF THE INVENTION

This invention relates to a shallow tray of the type for use on a worksurface or other support top, and particularly to an improved tray arrangement wherein multiple trays which can be vertically nested or stacked.

BACKGROUND OF THE INVENTION

Numerous document trays have been developed and utilized in office environments, such as for support on the top of a desk or worksurface, to permit storage of papers and like documents therein. Many such trays are also part of an assembly which, either through the tray structure itself, or through a separate frame or support structure, enables a plurality of such trays to be disposed in generally vertically stacked relationship to provide increased storage while minimizing the worksurface area utilized.

The present invention relates to an improved construction for trays of this general type and, more specifically, to a tray construction which enables several such trays to be disposed vertically one above the other and at least partially nested one within another, either when the trays are empty or contain only a small number of documents therein, to permit compact storage on a worksurface top while utilizing minimal space, and which additionally permits separation of documents through use of multiple trays. This tray construction in addition allows the trays to be vertically crossed-stacked one on top of another to provide for desired vertical separation and hence at least limited visibility and access to the individual trays in the stack, while at the same time providing significant storage capability and document separation while minimizing the amount of space utilized on the worksurface top.

In the improved tray of this invention, the tray has an enlarged but generally rectangular bottom wall which, at opposite longitudinal ends, is joined to upwardly extending end walls which are sloped outwardly as they project upwardly. The opposite sides of the bottom wall are joined to side walls which project upwardly, with these side walls also sloping outwardly as they project upwardly. The upper free edges of the outwardly-sloped side walls terminate in generally horizontal flanges which extend lengthwise along the side wall and project outwardly through a small distance. The end and side walls are preferably configured so as to not directly join together, thereby leaving open corners which improve visibility and access to the interior of the tray. The bottom wall of the tray on the bottom surface also has a plurality of positioning projections extending downwardly therefrom and spaced apart longitudinally along the tray by a distance which approximately corresponds to the transverse spacing between the upper edges of the side walls. Two vertically adjacent trays can be oriented in crossing or transverse relationship whereby the bottom wall of an upper tray in the vicinity of the respective end walls rests on the top flanges associated with the side walls of a next lower tray to permit vertical stacking of two or more trays, and the positioning projections on the upper tray project downwardly between the side walls of the lower tray to prevent transverse dislodgement of the upper tray.

The structural and functional advantages of the tray according to the present invention, and other objects and purposes thereof, will be apparent to persons upon reading the following specification and inspecting the accompanying drawings.

Figure 1:
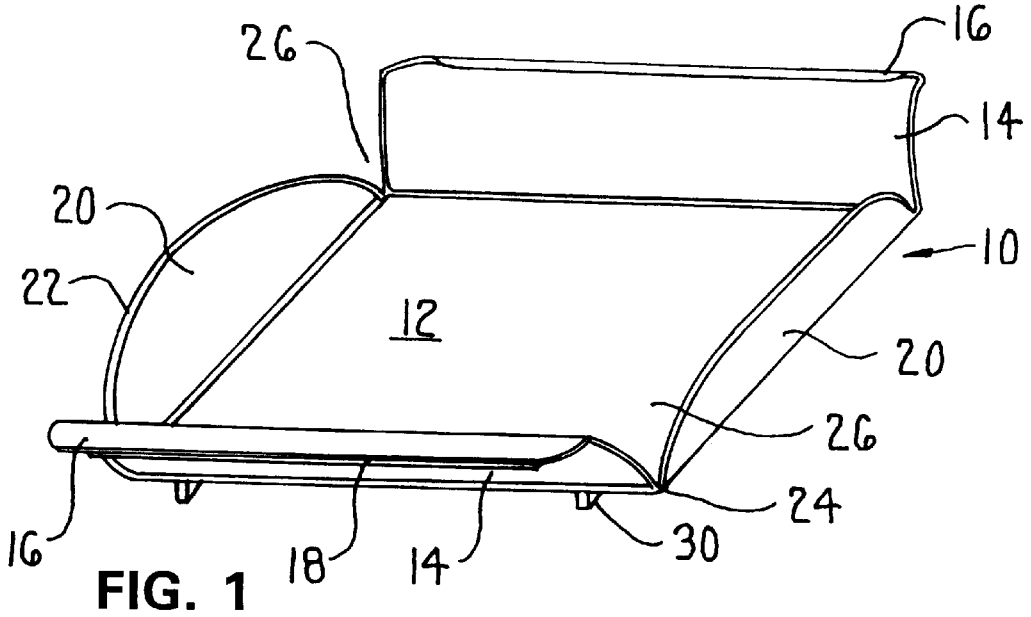
FIG. 1 is a perspective view showing a single tray according to the present invention.

In the following description, the words "upwardly", "downwardly", "rightwardly", and "leftwardly", will refer to directions in the drawings to which reference is made. The words "inwardly" and "outwardly" will refer to directions toward and away from the geometric center of the tray and designated parts thereof. Said terminology will include the words specifically mentioned, derivatives thereof, and words of similar import.

DETAILED DESCRIPTION

Referring to FIG. 1, there is illustrated a shallow but upwardly opening tray 10 according to the present invention, which tray is particularly adapted for use on worksurfaces and the like for storage of papers and similar documents.

The tray 10 can include a bottom wall 12 which is of a horizontally enlarged and substantially planar configuration, and preferably has a thin uniform thickness so as to resemble a sheet or plate-like construction. The bottom wall 12, when viewed from above, preferably has a rectangular configuration whereby the longitudinal length of the bottom wall thus significantly exceeds the transverse width thereof.

Figure 3:
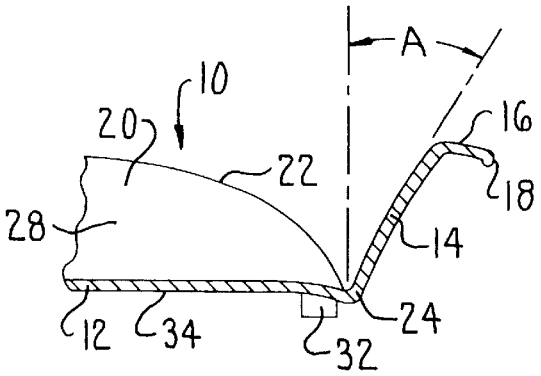
FIG. 3 is an enlarged fragmentary sectional view showing the side wall of the tray as taken along line 3—3 in FIG. 2.
Figure 4:
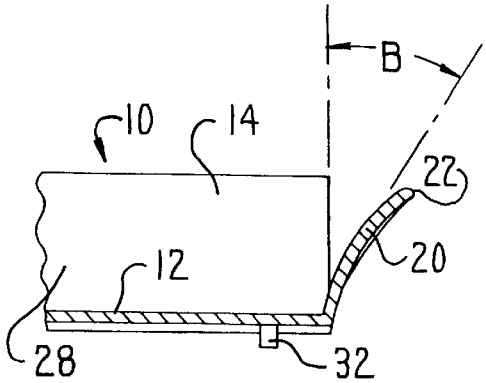
FIG. 4 is an enlarged fragmentary cross sectional view showing the end wall of the tray as taken along line 4—4 in FIG. 2.
Figure 5:
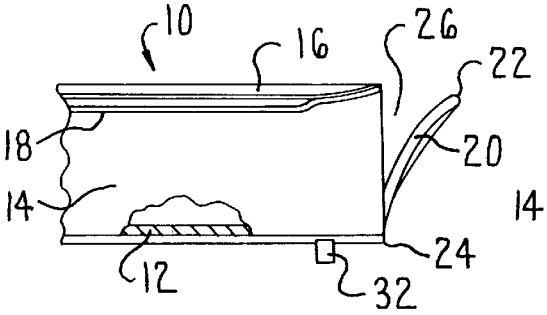
FIG. 5 is an enlarged fragmentary view along line 5—5 in FIG. 2 and illustrating a corner of the tray.

The bottom wall 12 along its longitudinally extending side edges is joined to upwardly projecting side walls 14, the latter being of short vertical extent relative to the dimensions of the bottom wall 12. Each side wall 14, as it projects upwardly relative to the bottom wall 12, is preferably angled outwardly relative to the vertical at a small angle A as illustrated in FIG. 3. This angle A is preferably between about 20° and 35°.

Each side wall 14 extends along substantially the entirety of the respective side edge of the bottom wall 12, and at its upper edge is fixedly joined to a top flange 16 which is substantially horizontally planar and projects outwardly from the side wall in a direction away from the bottom wall. This top flange 16 extends lengthwise along substantially the entire length of the side wall 14, but projects horizontally outwardly away therefrom through only a small distance so as to terminate at a free outer edge 18.

The tray 10 also has end walls 20 which projects vertically upwardly from the opposite end edges of the bottom wall 12. The end walls 20, similar to the side walls 14, are also angled outwardly at a small angle B relative to vertical as they project upwardly, and can additionally be provided with a somewhat rounded or upwardly convex configuration as they project upwardly so as to improve the aesthetics thereof if desired. The angle B is normally substantially equal to the angle A.

The end walls 20 project upwardly through a vertical height which substantially equals, or may be slightly less than, the upwardly projecting vertical height of the side walls 14. The end walls 20 also extend along substantially the entirety of the respective end edge of the base wall 12, but in the illustrated embodiment have an outer peripheral edge 22 which is of an arcuate or convexly rounded configuration, such as resembling part of a circumference of a circle, so that this rounded peripheral edge 22 merges or intersects the bottom wall 12 substantially at a corner 24 thereof.

Due to the outward and upward incline of the side walls 14 and end walls 20, and the rounded peripheral edge shape 22 of the end walls 20, the corners 26 of the tray are thus defined by substantially triangularly-shaped open regions which thus provide increased visibility and accessibility to the upwardly-opening compartment 28 defined within the tray.

Due to the open corner regions 26 of the tray, the side walls 14 and end walls 20 join solely to the respective edges of the bottom wall 12 and do not directly join to one another.

The tray 10, on the bottom wall 12 thereof, is provided with pairs of projections 30 and 32 which are joined to and project downwardly from the lower surface 34 of the bottom wall 12. The pair of projections 30 are secured to the bottom wall adjacent one end of the tray in the vicinity of opposite sides thereof, and the other pair of projections 32 are secured to the bottom wall adjacent opposite sides thereof in the vicinity of the other end of the tray. The longitudinal spacing between the projections 30 and 32 is slightly less than the width of the compartment 28 as defined perpendicularly between the side walls 14 adjacent the upper edges thereof so as to permit cross-stacking of like trays as explained below. The projections 30, 32 also function as feet when the tray sits directly on a worksurface.

The bottom width W of the compartment 28 is the width of the bottom wall 12 as measured substantially at the junction with the side walls 14, which bottom width W is less than the width W1 as defined at the top of the side walls 14. The bottom width W generally corresponds to a width sufficient to accommodate conventional sizes of papers or sheets therein, such as approximately $^{8-+b}$ ½ inches as an example.

Figure 2:
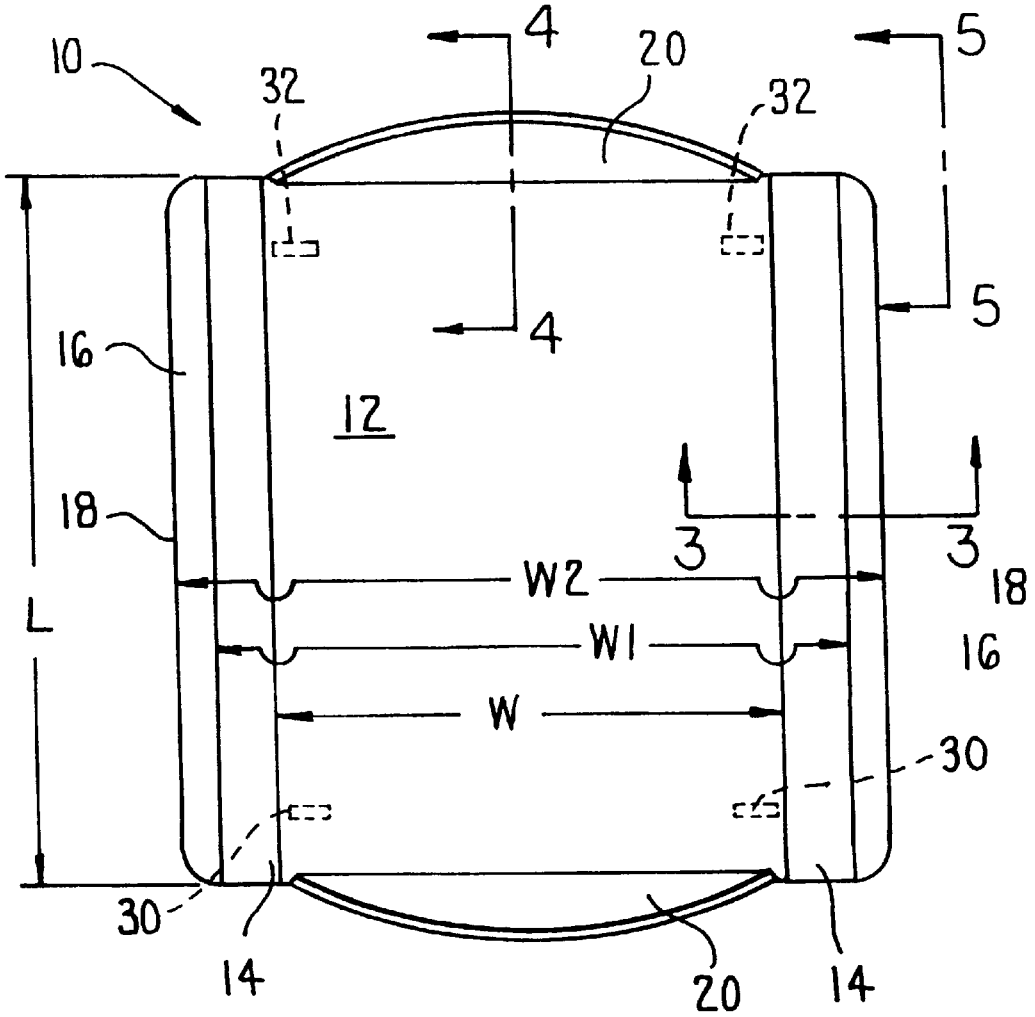
FIG. 2 is a top view of the tray of FIG. 1.

The maximum overall width of the tray 10, as illustrated in FIG. 2 is W2, the latter being measured perpendicularly between the free edges 18 of the top flanges 16. The tray also has a length L as measured at the bottom wall 12 of the tray, and this length L must exceed the width W1 and is preferably of a magnitude which is approximately equal to the width W2 so as to permit cross stacking like trays as illustrated in FIGS. 7 and 8.

Figure 7:
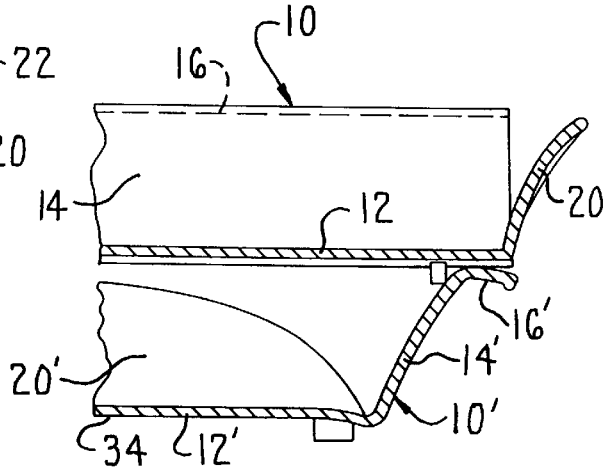
FIG. 7 is an enlarged, fragmentary sectional view which illustrates two trays in transverse stacked relationship.
Figure 8:
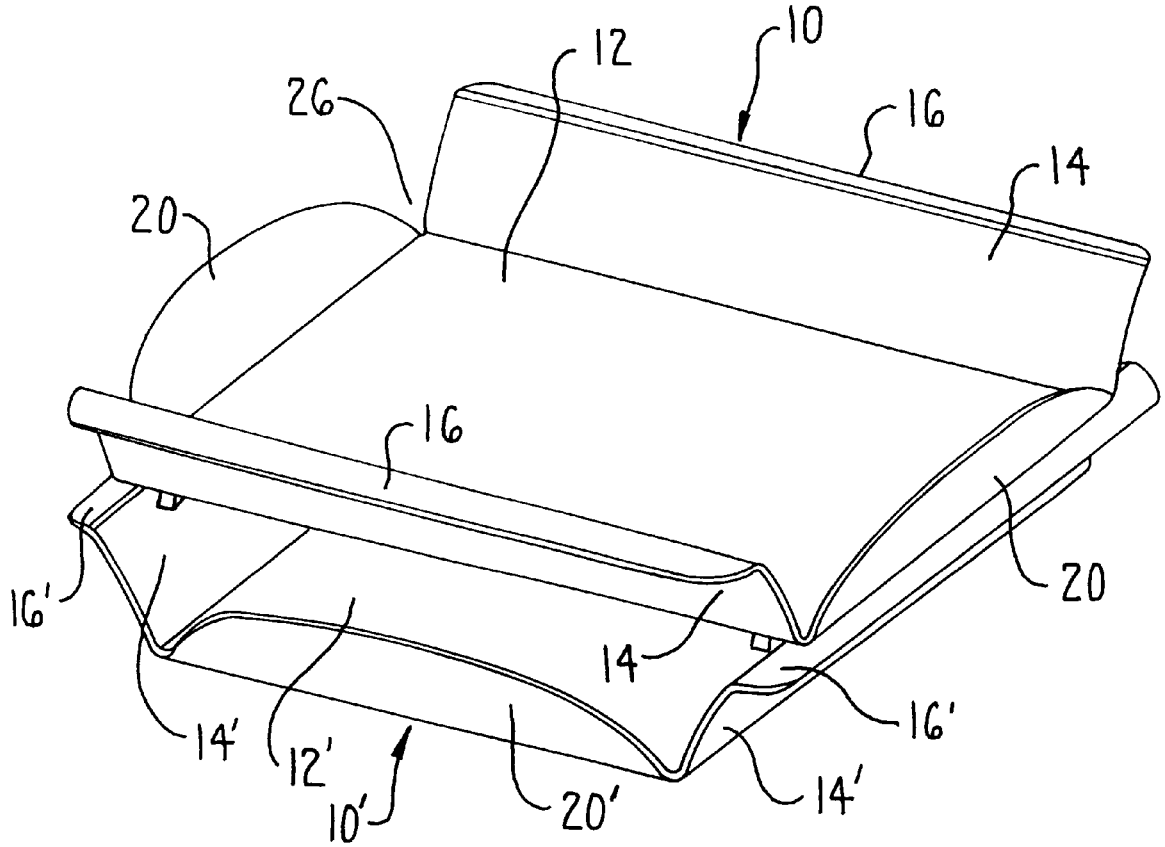
FIG. 8 is a perspective view which shows a pair of identical trays disposed in a cross stacking relationship.

By positioning like trays, such as trays 10 and 10' in FIGS. 7 and 8, in vertical positions one above the other and with the vertically adjacent trays longitudinally oriented at a 90° angle with respect to one another, the upper tray 10 can be vertically stacked entirely on top of the lower tray 10' since the length L of the upper tray 10 approximately equals or exceeds the maximum transverse width W2 of the lower tray 10' and enables the bottom wall of the upper tray 10 in the vicinity of the respective end walls to bear on the upper surfaces of the top flanges 16' associated with the lower tray 10'. When so disposed, the projections 30 and 32 of the upper tray 10 are positioned in close proximity to the inner surfaces of the side walls 14' of the lower tray 10' in the vicinity of the upper edges thereof, and thus the top tray 10 is prevented from being longitudinally slidably displaced so as to disrupt the cross stacking relationship between the trays.

While FIGS. 7 and 8 illustrate only two trays disposed in a cross stacking relationship, it will be appreciated that additional like trays could be suitably cross-stacked one on top of another. Further, when in this cross-stacked relationship, the overall configuration of the trays in terms of the storage compartment length being greater than the storage compartment width, and the additional openness provided by the open corner regions 26, thus greatly facilitates both visibility and at least limited access to papers in the stacked trays, including those trays which are not uppermost of this stack. When desired, however, a worker can readily lift and restack the trays so as to permit full access of any desired individual tray.

Figure 6:
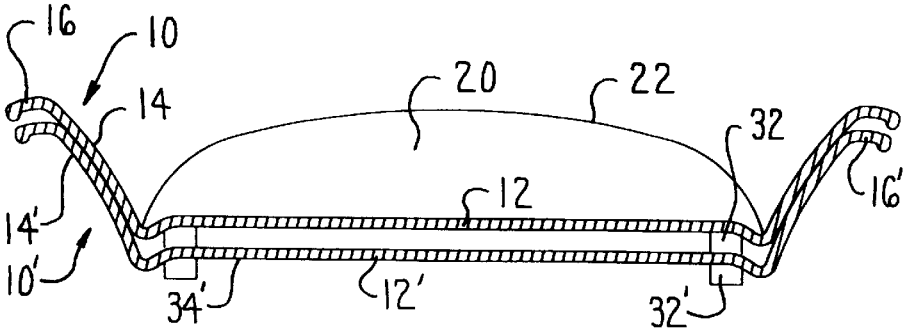
FIG. 6 diagrammatically illustrates, in central cross section, the manner in which two trays vertically nest one within another.

When compact storage of the trays is desired, then the trays can be positioned vertically in aligned relation directly above one another, and then seated or nested within one another, substantially as diagrammatically illustrated by trays 10 and 10' in FIG. 6. In this nested relationship, the basic body of one tray fits at least partially down into the compartment of the next lowermost tray in a conventional nesting relationship. Even in this nested relationship, however, the individual trays can still be provided with a limited number of documents therein if desired. The outward slope of the side and end walls of the individual trays facilitates this partial nesting of like trays.

The tray 10 according to the present invention is preferably constructed so as to have a substantially uniform but thin wall thickness throughout, with the material defining the individual walls resembling a thin sheet-like material. The tray is preferably constructed as a monolithic one-piece structure, such as by being formed of a thin plastics material, for example, by injection molding. Suitable plastics include ABS, PP, and HDPE.

While the stacked relationship shown in FIGS. 7 and 8 has only two trays in a cross-stacked relationship, it will be apparent that when a third like tray is stacked thereon, then the third tray will be cross stacked on top of the tray 10, and the third tray will thus be disposed in generally parallel but upwardly spaced relationship to the lower tray 10'. This alternating cross stacking relationship will thus continue based on the number of trays which are vertically stacked.

The trays of the present invention are lightweight and convenient to use, and at the same time possess desirable strength so as to permit their use in a cross-stacked manner. At the same time, the trays, whether nested or stacked, occupy minimal surface area on a worksurface top.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A stackable tray arrangement for use on a worksurface top for permitting storage of documents, the tray arrangement including a plurality of identical upwardly-opening shallow trays which each define an upwardly-opening storage compartment for deposit of papers and/or documents therein, each said tray comprising: a one-piece structure having a horizontally enlarged and substantially planar bottom wall of substantially rectangular shape having end edges and side edges, a pair of side walls projecting upwardly from opposite side edges of said bottom wall, said side walls being angled relative to the vertical so as to diverge with respect to one another as they project upwardly and terminate at upper edges, a substantially horizontally projecting top flange fixed to the upper edge of each said side wall and projecting horizontally outwardly from the side wall in a direction away from the bottom wall so as to terminate in a free edge, a width as measured between the free edges of the top flanges being at least approximately equal to a length of the bottom wall as defined between opposite end edges thereof, said bottom wall having projections fixed to and extending downwardly from a bottom surface thereof, said projections being spaced apart in the lengthwise extent of the bottom wall by a distance which approximately corresponds to the perpendicular spacing between inner upper edges of the side walls, whereby two said trays can be vertically stacked on top of one another in crossing relationship so that the bottom wall of an upper tray supportingly engages the top flanges of the lower tray, and the projections on the bottom wall of the upper tray nest generally between the side walls of the lower tray to prevent slidable displacement of the upper tray in its lengthwise direction.

2. A tray arrangement according to claim 1, wherein said tray has end walls which project upwardly from opposite end edges of said bottom wall, said end walls projecting upwardly through a height no greater than the side walls and being inclined relative to the vertical so that the opposite end walls of the tray diverge as they project upwardly.

3. A tray arrangement according to claim 2, wherein the end walls and the side walls of the tray respectively join solely to the respective edge of the bottom wall and do not directly join together so that corner regions of the tray are open and unobstructed.

4. A tray arrangement according to claim 3, wherein the tray is molded in its entirety as a one-piece monolithic plastic structure.

5. A tray arrangement according to claim 2, wherein the end walls and the side walls each have a bottom edge which, along the entire length thereof, is joined to the respective end or side edge of the bottom wall.

6. A tray arrangement according to claim 5, wherein the end walls and the side walls are nonpivotally fixed to the bottom wall.

7. A tray arrangement according to claim 2, wherein said side walls are solid and have a bottom edge which along the entire length thereof is joined to said bottom wall.

8. A tray arrangement according to claim 1, wherein the tray has end walls which project upwardly and incline outwardly from opposite end edges of the bottom wall, said end walls having a smoothly rounded and convex outer peripheral edge which at opposite ends terminates substantially at corners of the bottom wall.

9. A tray arrangement according to claim 8, wherein the tray is molded monolithic one-piece plastic structure.

10. A tray arrangement according to claim 1, wherein the tray is a molded monolithic one-piece plastic structure.

11. A stackable tray arrangement for use on a worksurface top for permitting storage of documents, the tray arrangement including a plurality of identical upwardly-opening shallow trays which each define an upwardly-opening storage compartment for deposit of papers and/or documents therein, each said tray comprising: a one-piece structure having a horizontally enlarged and substantially planar bottom wall of substantially rectangular shape having end edges and side edges, a pair of side walls projecting upwardly from opposite side edges of said bottom wall, said side walls being angled relative to the vertical so as to diverge with respect to one another as they project upwardly and terminate at upper edges, a substantially horizontally projecting top flange fixed to the upper edge of each said side wall and projecting horizontally outwardly from the side wall in a direction away from the bottom wall so as to terminate in a free edge, a width as measured between the free edges of the top flanges being at least approximately equal to a length of the bottom wall as defined between opposite end edges thereof, whereby two said trays can be vertically stacked on top of one another in crossing relationship so that the bottom wall of an upper tray supportingly engages the top flanges of the lower tray, said tray having end walls which project upwardly from opposite end edges of said bottom wall, said end walls projecting upwardly through a height no greater than the side walls and being inclined relative to the vertical so that the opposite end walls of the tray diverge as they project upwardly, said end and side walls of the tray respectively joining solely to the respective edge of the bottom wall and not directly joining together so that corner regions of the tray are open and unobstructed.

12. A tray arrangement according to claim 11, wherein the tray is a molded monolithic one-piece plastic structure.

13. A tray arrangement according to claim 11, wherein the end walls and the side walls each have a bottom edge which, along the entire length thereof, is joined to the respective end or side edge of the bottom wall.

14. A tray arrangement according to claim 11, wherein the end walls and the side walls are nonpivotally fixed to the bottom wall.

* * * * *